United States Patent [19]

Brown

[11] 4,217,854

[45] Aug. 19, 1980

[54] PAINT GUARD DEVICE

[76] Inventor: Claud E. Brown, 432 NW. 46 Ter., Oklahoma City, Okla. 73115

[21] Appl. No.: 929,459

[22] Filed: Jul. 31, 1978

[51] Int. Cl.[2] ..... B05C 11/16; B05C 17/12

[52] U.S. Cl. ..... 118/504; 15/257.9; 51/274; 33/448; 225/92

[58] Field of Search ..... 118/504, 505, 301, 406; 33/176, 177; 428/113; 15/257.1, 257.9; 51/274

[56] References Cited

U.S. PATENT DOCUMENTS

| | | | |
|---|---|---|---|
| 103,432 | 5/1870 | Disston | 118/504 |
| 298,834 | 5/1884 | Davenport | 33/176 |
| 764,482 | 7/1904 | Lord | 33/176 |
| 1,122,595 | 12/1914 | Hegardt | 33/176 |
| 1,147,722 | 7/1915 | Hegardt | 33/176 |
| 1,233,382 | 7/1917 | Malsin | 33/176 |
| 1,434,903 | 11/1922 | Manning | 118/504 |
| 2,155,169 | 4/1939 | Moses | 33/177 |
| 3,330,253 | 7/1967 | Rowe, Jr. | 118/504 |
| 3,526,965 | 9/1970 | Haefele | 33/177 |

*Primary Examiner*—Travis Brown

*Attorney, Agent, or Firm*—William R. Laney

[57] ABSTRACT

A device for guarding against the placement of paint in unwanted areas during painting, including an elastomeric body having a butt edge and a feather edge opposite the butt edge for cutting in a line defining the boundary of a painted area. A handle is formed integrally with, or attached at one of its ends to, the butt edge of the elastomeric body, and projects from the body. Embedded within the elastomeric body are a plurality of flexible reinforcing elements, which elements can be bent, along with the elastomeric body, to retain the elastomeric body in a curved configuration so that the feather edge thereof, in conforming to such curvature, can be used for cutting in an area lying in a curved geometric surface. The flexible reinforcing elements preferably extend transversely across the elastomeric body, as well as lengthwise therein. A protective and straightening metallic sheath is provided for sliding encasement of the feather edge of the elastomeric body, and assures that that edge can be retained in a straight configuration lying in a single plane, and is protected when not in use.

10 Claims, 6 Drawing Figures

PAINT GUARD DEVICE

BACKGROUND OF THE INVENTION

1. Field of the Invention

This invention relates to painter's accessories, and more particularly, to a manually manipulatable guard or shield device which can be quickly placed over a surface to be masked so as to allow painting to proceed rapidly up to a precise boundary line of the masked area, with such paint guard or shielding device being conformable to substantially any desired shape in order that curved surfaces can be painted with equal benefit derived from the use of the paint guard device.

2. Brief Description of the Prior Art

In painting, it is frequently necessary to cut in a particular painted area so that the boundary line of the area to be painted must follow carefully a predetermined line in order to avoid paint being inadvertently placed on adjacent areas or structures, resulting in an unsightly and unsatisfactory work product. For the purpose of cutting in paint in this fashion, a number of techniques have been used. For example, on window sashes at that point adjacent the location where the window pane engages the sash, it has sometimes been the practice to place masking tape over the window pane at the location where the pane enters the sash so that inadvertent placement of paint on the window pane is avoided. In other situations, a piece of cardboard having a relatively thin edge has been hand held at a location which is to be covered and shielded from paint, and the paint has been applied with a brush held in the other hand of the painter. This technique is tedious and time-consuming, and still requires substantial care and dexterity in the handling of the masking sheet of cardboard.

In the field of drafting and cartography, various devices have been provided previously to permit lines or marks of various types to be scribed on a surface in conformity with a preselected geometric pattern. Thus, various means have been provided for drawing French curves and other geometric shapes. In some instances, it has been proposed to permit the type of line or area which is to be demarcated to be selectively altered by providing an elongated ruler made of a bendable elastomeric material, and having embedded therein pieces of metal which have sufficient stiffness and rigidity that the ruler, when bent, will remain conformed to the shape into which it is bent until a restoring bending force is applied to it. In this way, the ruler can be used to draw a curved of predetermined configuration, and can be used many times for drawing different types of curves. Generally, the configuration of devices of this sort has been substantially that of a conventional ruler or yardstick. Examples of device which may be termed flexible rulers are to be found in U.S. Pat. Nos. 1,233,382; 3,526,965; 2,155,169; 1,147,722 and 1,122,595.

BRIEF DESCRIPTION OF THE PRESENT INVENTION

The present invention provides a paint guard or shielding device which can be used to prevent the inadvertent placement of paint on an area or in a zone where it is not desired, but which otherwise might become painted in the course of painting adjacent areas if some type of shielding were not provided. The paint guard device of the invention is quite flexible in its usage in that it can be used in several ways, and is not confined in its utility to employment where flat surfaces are being painted, or where a large access zone for placement and handling of a shielding device is available adjacent the area to be painted.

Broadly described, the paint guard device of the invention comprises an elastomeric body which is preferably generally rectangular in its overall configuration with a very fine or feather edge located along one side thereof. This edge is thin and straight in the normal primary position or status of the paint guard device. On the opposite side of the elastomeric body from the feather edge, a butt side or edge is located which is relatively thick to provide substantial mechanical strength to the device, and also to function as an anchoring or attachment point for a handle by which the device is manipulated by the user. The handle projects substantially normal to the butt edge of the elastomeric body and may be formed integrally with the body and of substantially the same elastomer, but characterized by greater hardness and rigidity. Alternatively, a separate handle may be threaded into or otherwise suitably secured to the elastomeric body at the butt edge thereof.

A plurality of elongated, relatively thin flexible reinforcing elements extend in a generally fan-shaped configuration from the butt end of the elastomeric body outwardly toward the feather edge thereof and terminate in relatively close proximity to the feather edge. There are also provided a plurality of substantially parallel similar reinforcing elements which extend lengthwise in the elastomeric body substantially parallel to the feather edge thereof. The reinforcing elements may be constructed of metal (such as wire) or plastic, but generally are characterized by properties which permit retention of a shape or form into which they are bent until a restorative force is applied thereto.

A final element of the paint guard device of the invention is a protective and straightening metallic sheath which is slidably engaged with the feather edge of the elastomeric body to protect the feather edge, and to assure that it remains perfectly straight during some usages of the paint guard device.

An important object of the invention is to provide a paint guard device which can be easily used to cut in or define a painted area adjacent an area which is not to be painted, with the boundary between the two areas being precisely located, and the unpainted area guarded or shielded by the device during painting.

Another object of the invention is to provide a paint shield or guard which can be easily manually shaped to an arcuate configuration along a feather edge thereof so that cylindrical poles or other curved surfaces can be painted with precision in the sense of the paint terminating at a precisely selected boundary which is guarded or protected by the use of the paint guard device.

Another object of the invention is to provide a paint guard device which is characterized by a long trouble free service life, during which it can be flexed or bent to increase the number of uses which can be made with the device.

Additional objects and advantages of the invention will become apparent from the following detailed description of a preferred embodiment of the invention, when such description is read in conjunction with the accompanying drawing which illustrates such preferred embodiment.

GENERAL DESCRIPTION OF THE DRAWING

DETAILED DESCRIPTION OF A PREFERRED EMBODIMENT OF THE INVENTION

Figure 1:
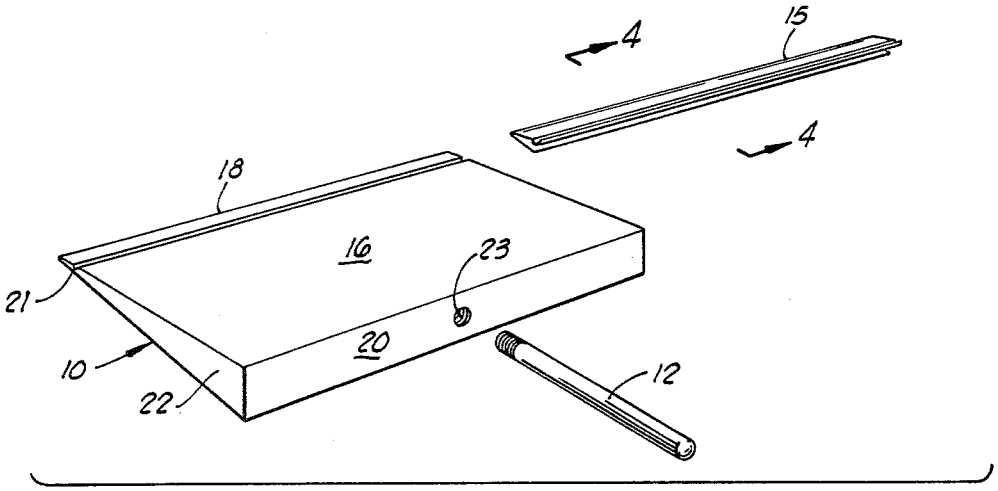
FIG. 1 is an exploded perspective view showing, in detached relation, in end perspective, the parts of the paint guard device of the invention.

The paint guard device of the invention generally includes an elastomeric body 10 having threadedly secured to one side thereof a handle 12. A protective and straightening metallic sheath 15 constitutes another major element of the paint guard device.

Referring in greater detail to the elastomeric body 10 of the paint guard device, in the illustrated embodiment of the invention, this body is of pyramidal configuration and includes a pair of substantially rectangular opposite sides 16 which converge to a feather edge 18 at one side edge of the device and a relatively thick butt edge 20 at the opposite sides thereof. An elongated groove 21 extends across the body 10 in the upper side 16, and is parallel to the feather edge 18. The end faces of the elastomeric body are denominated by reference numeral 22 and are triangular in configuration. It should be pointed out that it is not essential that the elastomeric body 10 be shaped in the precise form described, but it is important to the principles of the invention that the body have a relatively long feather edge 18 along one side thereof which is very thin, and a relatively thick butt portion, such as the butt edge 20, along the opposite side thereof.

The elastomer from which the elastomeric body 10 is constructed can be various well-known materials, such as rubber, polyurethane, or any sufficiently resilient material. Preferably, however, the material is resistant to deterioration resulting from contact with paint.

About midway along the butt edge 20 of the device, a threaded handle-receiving cavity 23 is formed in the butt edge and functions to threadedly receive the threaded end of the handle 12. It should be pointed out that in some forms of the paint guard device, the handle can be molded integrally with the elastomeric body 10, in which case the elastomeric material in the handle is preferably formed to impart to it greater rigidity and hardness than that characterizing the elastomeric body 10.

Figure 3:
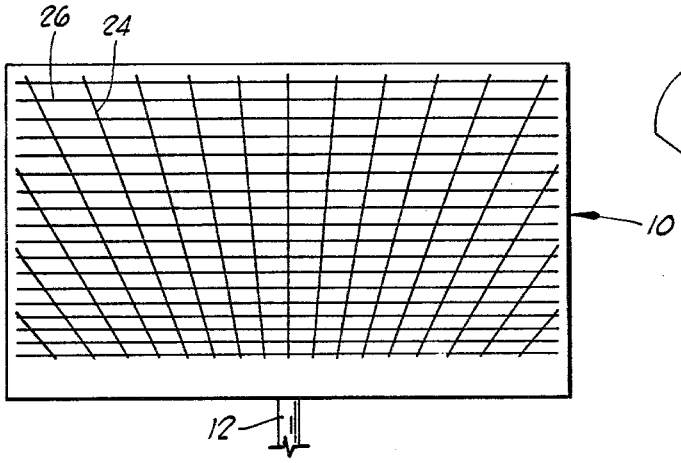
FIG. 3 is a sectional view taken along line 3—3 of FIG. 2.

As illustrated in FIG. 3 of the drawing, there are embedded within the elastomeric body 10, a plurality of elongated, relatively thin flexible reinforcing elements. In the illustrated embodiment of the invention, these are wire elements which are capable of retaining the shape to which they are bent until a restorative force is applied to them. The wires are preferably characterized in having the capability of undergoing flexing a great number of times without fracturing or breaking. As shown in FIG. 3, one series of wires 24 are spaced from each other along the length of the elastomeric body 10 and are arrayed in a fan-shaped configuration so that the outer ends of the wires which are closest to the feather edge 18 are spaced slightly farther from each other than are those which are nearest adjacent the butt edge 20. This assures a greater flexibility in the elastomeric body adjacent the feather edge, and greater rigidity and strength adjacent the butt edge.

A second set of flexible reinforcing elements 26 extends lengthwise in the elastomeric body 10 or, stated differently, parallel to the feather edge 18. The elongated reinforcing elements 26 can be identical in material of construction and diametric size to the reinforcing elements 24.

Figure 2:
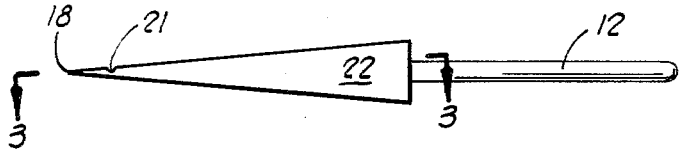
FIG. 2 is an end view of the elastomeric body forming a part of the paint guard device of the invention.

The reinforcing elements function to prevent the elastic qualities of the elastomer from which the body 10 is constructed from causing the body to spring back to the original shape or form in which it is molded, which is that illustrated in FIGS. 1–3. Thus, where it may be desired to paint to a precise circumferential line around a pole or on a curved surface, the elastomeric body can be manually made to conform to the curvature of the pole or surface so that the feather edge 18 thereof coincides precisely with the circumferential line which is to form the boundary of the painted area. This general configuration to which the elastomeric body 10 of the paint guard device can be formed is generally illustrated in FIG. 6.

Figure 5:
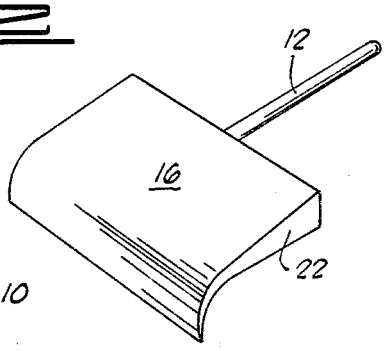
FIG. 5 is a perspective view of the paint guard device in one of its operative positions.
Figure 4:
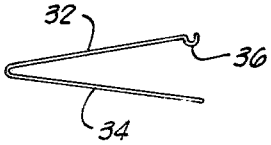
FIG. 4 is a sectional view taken along line 4—4 of FIG. 1.
Figure 6:
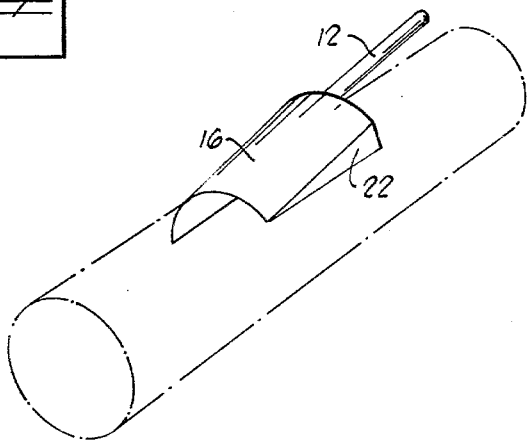
FIG. 6 is a perspective view of the paint guard device in another operative position, and illustrating in dashed lines, a cylindrical pole being painted.

It is also possible to curve the elastomeric body 10 in a plane extending normal to that in which the body has been curved in FIG. 6. The appearance of the elastomeric body, when it is curved in the manner last described, is illustrated in FIG. 5. This particular configuration of the elastomeric body 10 has great utility where a right angle geometry exists in the vicinity of the area to be painted, rendering it difficult to develop access to that area for placement of the paint guard device. An example of this would be at the intersection or point of joinder of a wall and floor where it is very awkward and difficult to establish the boundary at which paint applied to the wall is to be stopped as it is brought down near to the floor. By curving the elastomeric body 10 in the manner illustrated in FIG. 5, the handle 12 can be held quite close to the floor, and the body 10 then curved sufficiently that the feather edge 18 thereof can be placed flatly against the wall to establish the line or demarcation between the area to be painted and that which is to be guarded or shielded from painting.

The final element of the paint guard device of the invention is a protective and straightening metallic sheath 15. The metallic sheath 15 is of generally V-shaped cross-sectional configuration, and is substantially equal in length to the feather edge 18 of the elastomeric body 10. The angle defined between the two legs 32 and 34 of the metallic sheath 30 conforms to the angle which is defined between the opposed surfaces 16 of the elastomeric body 10 at the location where these surfaces converge in the feather edge 18. It will be noted that the leg 32, at its free edge, or stated differently, at its edge opposite that edge at which the two legs are joined, carries a small U-shaped lip 36.

The protective metallic sheath 30 is used by sliding it lengthwise over that portion of the elastomeric body 10 which is immediately adjacent the feather edge 18, so that the feather edge is encased within the metallic sheath 30, and the U-shaped lip 36 slides into and mates with the groove 21. Encasement of the feather edge 18 within this sheath will assure that a perfectly straight, relatively thin rigid edge is provided at the location of the sheath. This is very desirable where it is essential that a perfectly straight fine edge be provided, and in this respect the sheath is very useful after the paint guard device has been used a number of times, and has been deformed to semi-circular, curved or other configurations many times in the course of painting. Between usages of the paint guard device, application of the metallic sheath 30 to the feather edge portion of the elastomeric body 10 will assist in restoring the elastomeric body to its original pyramidal configuration in which the feather edge 18 lies in a perfectly straight line. Moreover, during this time, the feather edge is protected from inadvertent destructive contact with possible chipping or nicking of the feather edge 18 resulting. As indicated, too, the metallic sheath frequently is very useful to maintain in place during painting to provide assurance that a perfectly straight feather edge of metal is provided on a flat surface which is to be cut in during painting. Concurrently, the metallic sheath often is valuable in protecting the elastomeric feather edge of the paint guard device from contact with erosive or corrosive types of paint which may be relatively more incompatible with the elastomer of which the body 10 is made than most paints.

The groove 21, as well as the U-shaped lip 36 both function to block or prevent running of paint from the feather edge 18 up the body 10 toward the butt edge.

From the foregoing description of the invention, it will be apparent that the paint guard device of the invention is a highly useful article which can be employed in various ways to assist the painter in painting with precision only in those areas to which the paint is intended to be applied. Although a preferred embodiment of the invention has been herein described in order to illustrate the principles underlying the invention, it will be understood that various changes and innovations in the illustrated and described structure can be effected without departure from the principles of the invention. Changes and innovations of this type are therefore deemed to be circumscribed by the spirit and scope of the invention, except as the same may be necessarily limited by the appended claims or reasonable equivalents thereof.

What is claimed is:

1. A paint guard device comprising:

an elastomeric body of substantially pyramidal configuration having a straight, thin feather edge on one side thereof, having a butt edge along the side thereof opposite the feather edge, and having a pair of surfaces at opposite sides thereof converging to said feather edge and each extending from said feather edge to said butt edge;

a handle secured to the body at the butt edge thereof and projecting from the body; and flexible, reinforcing elements embedded in said body and cooperating with the elastomer therein to allow selective deformation of said feather edge to a selected curved configuration by manual deformation of the elastomeric body, followed by retention of said selected curved configuration after said manual deformation, said reinforcing elements including a plurality of elongated wires, including a group of spaced wires disposed in a fan-shaped array with the ends of said wires closest to said butt edge being relatively closer to each other than the ends of said wires relatively close to said feather edge.

2. A paint guard device as defined in claim 1 wherein said reinforcing elements include a second group of wires extending across said elastomeric body substantially parallel to each other and to said feather edge.

3. A paint guard device as defined in claim 1 and further characterized as including a protective and straightening sheath slidably engaging said elastomeric body and protectively sheathing said feather edge.

4. A paint guard device as defined in claim 3 wherein said sheath is an elongated, straight metallic member of V-shaped cross-sectional configuration.

5. A paint guard device as defined in claim 4 wherein said elastomeric body is characterized in including a groove extending parallel to said feather edge, and slidingly receiving a portion of said metallic sheath therein.

6. A paint guard device as defined in claim 1 wherein said handle and elastomeric body are integrally molded as a unitary member.

7. A paint guard device as defined in claim 1 and further characterized as including a protective and straightening sheath slidingly engaging said elastomeric body and protectively sheathing said feather edge.

8. A paint guard device as defined in claim 7 wherein said sheath is an elongated, straight metallic member of V-shaped cross-sectional configuration.

9. A paint guard device as defined in claim 8 wherein said elastomeric body is characterized in including a groove extending parallel to said feather edge, and slidingly receiving a portion of said metallic sheath therein.

10. A device for selectively protecting plane and curved surfaces adjacent a line in that surface from the application of paint on one side of said line during painting on the other side of said line, said device comprising:

an elastomeric body having a straight, thin feather edge along one side thereof;

flexible, reinforcing elements embedded in said body and cooperating with said elastomer therein to allow selected deformation of said feather edge to a selected curved configuration in either of two planes, said flexible reinforcing elements comprising:

a first group of spaced wires extending adjacent said feather edge into said elastomeric body, the wires in said first group having ends adjacent said feather edge and second ends spaced inwardly in said elastomeric body from said feather edge; and a second group of spaced wires extending across said elastomeric body substantially parallel to each other and to said feather edge, the wires in said first group of spaced wires converging toward each other as they extend away from said feather edge to assume, collectively, a fan-shaped array.

* * * * *